US005373643A

United States Patent [19]

Warren

[11] Patent Number: 5,373,643

[45] Date of Patent: Dec. 20, 1994

[54] ENHANCED EATING IMPLEMENTS FOR A HANDICAPPED PERSON

[76] Inventor: Michael D. Warren, Rte. 2, Box 2095, Sikeston, Mo. 63801

[21] Appl. No.: 29,523

[22] Filed: Mar. 11, 1993

[51] Int. Cl.[5] ..... A47J 43/28

[52] U.S. Cl. ..... 30/322; 30/323; 30/324; 30/327; 30/340

[58] Field of Search ..... 30/322, 323, 327, 334, 30/340, 343, 137, 142, 147, 148, 149, 150, 324, 325, 326; 16/110 R, 111 R, 125

[56] References Cited

U.S. PATENT DOCUMENTS

| | | | |
|---|---|---|---|
| D. 43,208 | 10/1912 | Stuver | 30/327 |
| D. 196,133 | 8/1963 | Brown | 30/323 |
| 527,115 | 10/1894 | Kimball | 30/327 |
| 1,273,642 | 7/1918 | Margetts | 30/327 |
| 1,300,008 | 4/1919 | Plasclascovitie | 30/327 |
| 1,406,135 | 2/1922 | Abrell | 30/327 |
| 1,857,500 | 5/1932 | Davison | 30/322 |
| 2,748,479 | 6/1956 | Levin | 30/323 |
| 2,942,342 | 11/1957 | Warren et al. | 30/327 |
| 4,172,321 | 10/1979 | Greenberg | 30/340 |

FOREIGN PATENT DOCUMENTS

| | | | |
|---|---|---|---|
| 4087 | of 1895 | United Kingdom | 30/327 |
| 438474 | 11/1935 | United Kingdom | 30/327 |

*Primary Examiner*—Richard K. Seidel
*Attorney, Agent, or Firm*—David L. Baker

[57] ABSTRACT

A handle for eating utensils (such as a fork, a spoon and a knife) has a gripping member and a barrier member. A first connecting member connects one end of the gripping member to one end of the barrier member. A second connecting member releasingly connects another end of the gripping member to another end of the barrier member. A hand insertion port is formed by an inner perimeter of the gripping member, the barrier member, the first connecting member and the second connecting member. There is a stabilizing member connected to the gripping member.

5 Claims, 3 Drawing Sheets

ENHANCED EATING IMPLEMENTS FOR A HANDICAPPED PERSON

BACKGROUND OF THE INVENTION

1. Field of the Invention

This invention relates to a handle designed to enable a handicapped person to use eating utensils such as a knife, fork and spoon when the person's hands are not capable of sufficiently gripping the handles of a standard utensil handle.

2. Description of the Related Art

Previous patents have addressed modified silverware but have not addressed the problem of the arthritic or handicapped person.

U.S. Pat. No. 4,835,864 to H. H. Tang on Jun. 6, 1989 for a Combination Fork/Spoon Utensil describes a handle with a forked end having a receiving slot to accommodate a shaft of a spoon attachment.

U.S. Pat. No. 4,863,033 to F. G. Buj on Sep. 5, 1989 for a Set of Eating Utensils for Children shows a spoon, fork and knife with a decorative handle to encourage children to use the implements thereby developing the necessary coordination and hand skills. The present invention addresses the problems encountered by people having reduced ability in their hands especially in gripping eating utensils.

SUMMARY OF THE INVENTION

This invention addresses the difficulty handicapped, injured and arthritic people have using conventional tableware. The enhanced handle of the present invention is designed to make picking up and handling silverware easier. The handle and the accompanying knife, fork or spoon is designed for ease of manufacture. Thus the cost of manufacture is reduced which lowers the cost to the user.

A first alternative embodiment of a handle for eating utensils (such as fork, a spoon and a knife) has a gripping member and a barrier member. There is a first connecting member connecting one end of the gripping member to one end of the barrier member. A second connecting member connects another end of the gripping member to another end of the barrier member. A hand insertion port is formed by an inner perimeter of the gripping member, the barrier member, the first connecting member and the second connecting member.

A second alternative embodiment of a handle for eating utensils has a gripping member and a barrier member. There is a first connecting member connecting one end of the gripping member to one end of the barrier member. In this embodiment, a second connecting member releasingly connects another end of the gripping member to another end of the barrier member. A hand insertion port is formed by an inner perimeter of the gripping member, the barrier member, the first connecting member and the second connecting member.

It is an object of this invention to provide an enhanced handle that allows a person incapable of properly gripping a standard handle, usually found on a knife, fork and spoon, to keep the utensil within his or her hand.

DESCRIPTION OF THE PREFERRED EMBODIMENT

Figure 1:
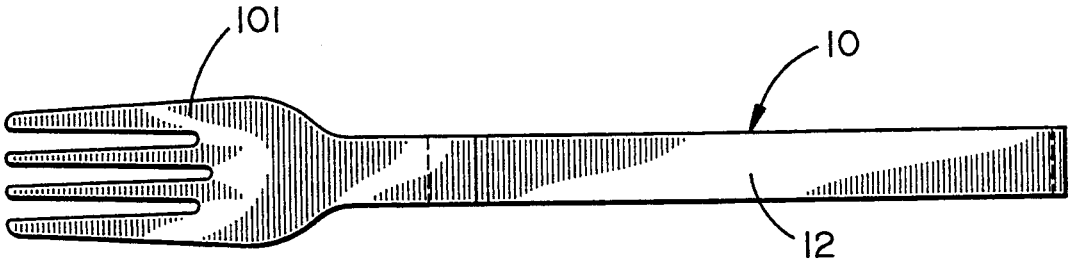
FIG. 1 is a top view of a handle, as described, shown utilized on a fork.
Figure 2:
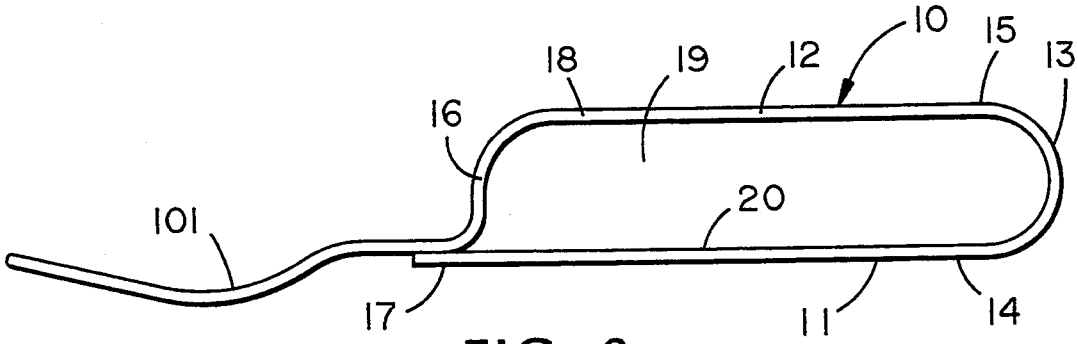
FIG. 2 is a front view of the handle utilized on the fork.
Figure 3:
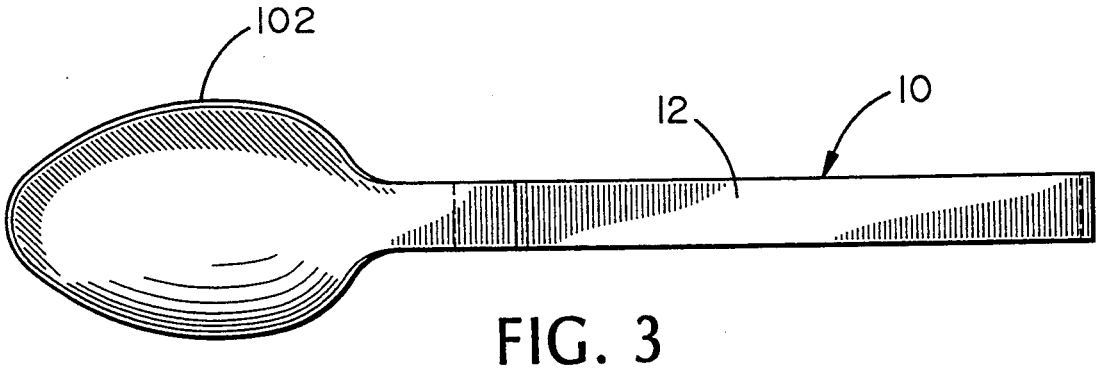
FIG. 3 is a top view of a handle, as described, shown utilized on a spoon.
Figure 4:
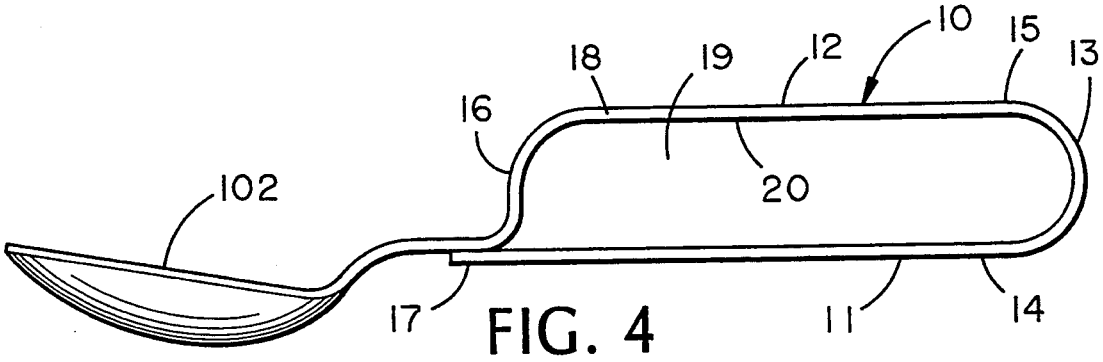
FIG. 4 is a front view of the handle utilized on the spoon.
Figure 5:
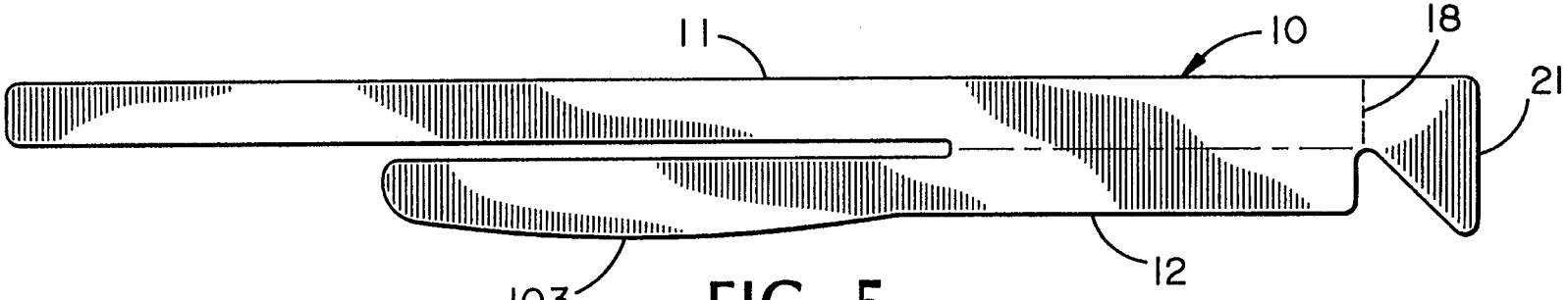
FIG. 5 is a top view of a handle, as described, shown utilized on a knife. The handle is shown before it is formed into its normally utilized shape to better show a step in its manufacture.
Figure 6:
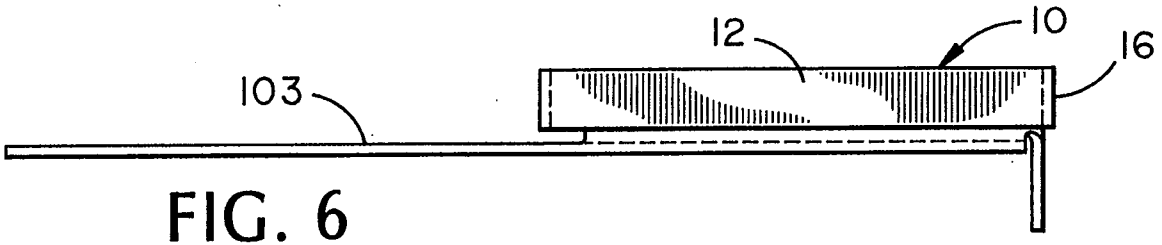
FIG. 6 is a top view of the handle utilized on the knife.
Figure 7:
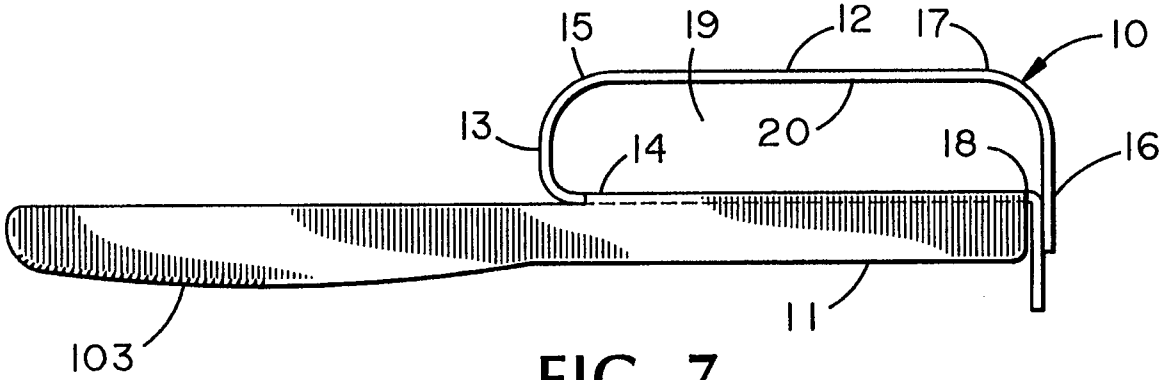
FIG. 7 is a front view of the handle utilized on the knife.
Figure 8:
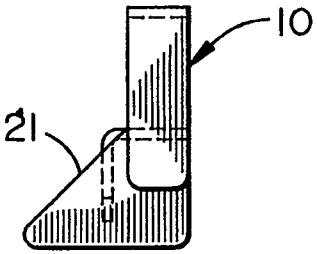
FIG. 8 is a right side view of the handle utilized on the knife.
Figure 9:
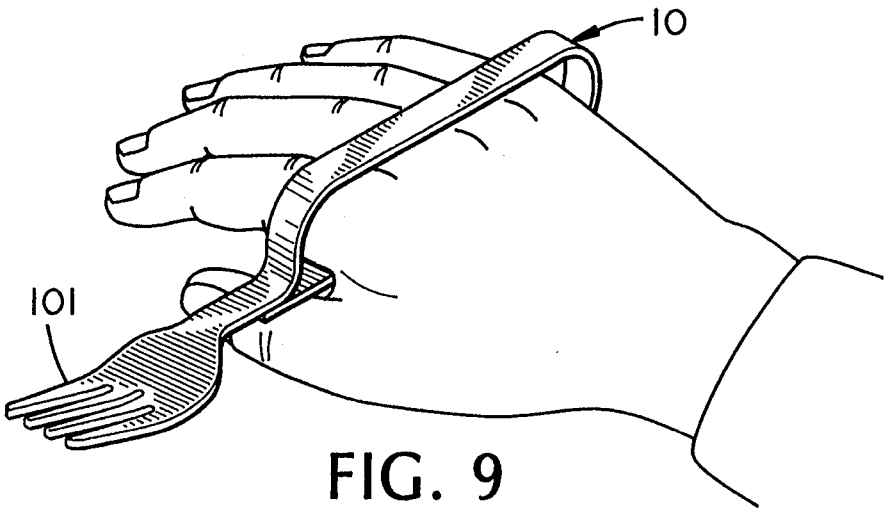
FIG. 9 is perspective view of the handle with a hand placed within the hand insertion port to better illustrate the use of the handle.
Figure 10:
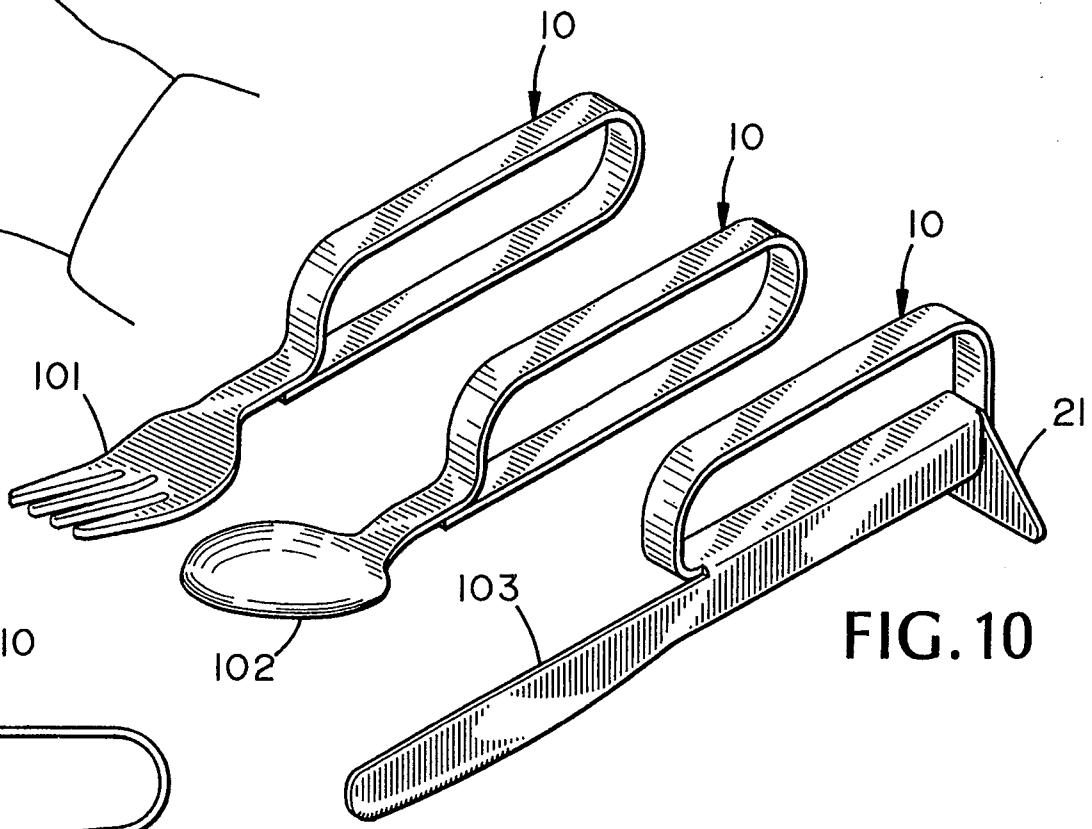
FIG. 10 is a perspective view of the handle shown on a fork, a spoon and a knife. The illustration of the knife shows the stabilizing member placed thereon.
Figure 11:
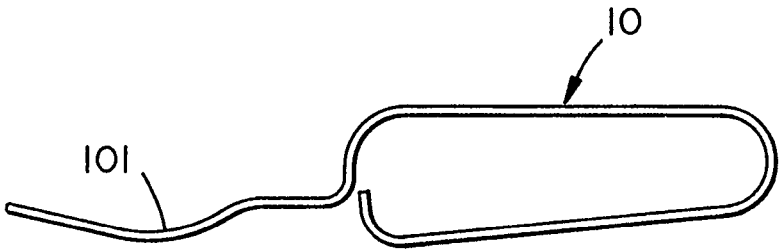
FIG. 11 is a perspective view of the handle showing the gripping member released from its connection to the second connecting member to allow the hand insertion port to be expanded.

Referring to FIGS. 1 through 11, a handle 10 for eating utensils (such as a fork 101, a spoon 102 and a knife 103) has a gripping member 11 and a barrier member 12. A first connecting member 13 connects one end 14 of the gripping member 11 to one end 15 of the barrier member 12. A second connecting member 16 releasingly connects another end 17 of the gripping member 11 to another end 18 of the barrier member 12. A hand insertion port 19 is formed by an inner perimeter 20 of the gripping member 11, the barrier member 12, the first connecting member 13 and the second connecting member 16. There is a stabilizing member 21 connected to the gripping member 11. The stabilizing member 21 is shown on the handle 10 having the knife 103 attached. But the stabilizing member 21 could be attached to the handle 10 having a the fork 101 or the spoon 102 attached.

In operation, the hand is placed through insertion port 19 and the user grips the gripping member 11 to the best of his or her ability. The barrier member 12 reduces the chance of the handle 10 falling from the hand of the user and makes eating with the utensil a more productive endeavor by reducing spillage from the eating utensils 101, 102 and 103. The releasable connection of second connecting member 16 allows the user to enlarge the area of the hand insertion port 19 to accommodate a larger hand. The stabilization member 21 allows the handle 10 to remain in an upright position shown in FIG. 10 to allow the user to place their hand into the hand insertion port 19 and grasp the gripping member 11 more easily than if the handle 10 were to fall on its side.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A handle for eating utensils for use by a handicapped person comprising:

(a) a gripping member comprising a right rectangular parallelopiped having:
a rear gripping end;
a forward gripping end;
a gripping width dimension; and
a gripping length dimension substantially greater than said gripping width dimension;

(b) a barrier member comprising a right rectangular parallelopiped having:
a rear barrier end;
a forward barrier end;
a barrier width dimension; and
a barrier length dimension substantially greater than said barrier width dimension, said barrier length dimension being substantially equivalent in length to said gripping length dimension of said gripping member;

(c) a first curved connecting member for connecting the rear gripping end of the gripping member to the rear barrier end of the barrier member, and for maintaining the rear gripping end and said rear barrier end a first substantially fixed distance apart;

(d) a second curved connecting member for connecting the forward gripping end of the gripping member to the forward barrier end of the barrier member, and for maintaining the forward gripping end and said the forward barrier end a second substantially fixed distance apart, said second substantially fixed distance apart being substantially equivalent to said first substantially fixed distance apart;

(e) a hand insertion port formed by an inner perimeter of the gripping member, the barrier member, the first curved connecting member, and the second curved connecting member;

(f) said handle being formed from one continuous sheet of material, said handle also having a constant width dimension and thickness, said width dimension being substantially greater than said thickness.

2. A handle for eating utensils according to claim 1, said handle further comprising a stabilizing member for holding said handle in an upright position such that said barrier member lies substantially vertically above said gripping member, said stabilizing member being connected to the rear gripping end of said gripping member.

3. A handle for eating utensils according to claim 2, said first curved connecting member being substantially C-shaped.

4. A handle for eating utensils according to claim 3, wherein said second curved connecting member is substantially S-shaped.

5. A handle for eating utensils according to claim 2, wherein:

(a) said first curved connecting member is substantially L-shaped; and (b) said second curved connecting member is substantially C-shaped.

* * * * *